United States Patent [19]

Decker et al.

[11] Patent Number: 4,889,472

[45] Date of Patent: Dec. 26, 1989

[54] AIR SPEED CONTROL VALVE AIR PRESSURE DRIVE HYDRAULIC FLUID PUMP

[75] Inventors: Arnold F. Decker; Timothy L. Silke, both of Aurora, Ill.

[73] Assignee: Templeton, Kenly & Co., Broadview, Ill.

[21] Appl. No.: 185,521

[22] Filed: Apr. 25, 1988

[51] Int. Cl.[4] ..... F04B 17/00

[52] U.S. Cl. ..... 417/46

[58] Field of Search ..... 417/46, 47; 137/115; 251/117

[56] References Cited

U.S. PATENT DOCUMENTS

| | | | |
|---|---|---|---|
| 489,516 | 1/1893 | Wood | 417/46 |
| 2,223,044 | 11/1940 | Miller | 251/117 X |
| 2,264,753 | 12/1941 | Henkel | 417/47 |
| 2,509,880 | 5/1950 | Pelton | 303/88 |
| 2,630,758 | 3/1953 | Henkel . | |
| 2,687,742 | 8/1954 | Crookston | 137/115 |
| 2,765,804 | 10/1956 | Dinkelkamp | 137/102 |
| 2,861,519 | 11/1958 | Houle . | |
| 2,928,646 | 3/1960 | Ashbrook | 251/63 |
| 2,976,880 | 3/1961 | Cassarino et al. | 137/219 |
| 3,359,868 | 12/1967 | Hoffman et al. | 91/447 |
| 3,590,839 | 7/1971 | Moore | 137/71 |
| 3,787,027 | 1/1974 | Curnow et al. | 251/63 |
| 3,816,025 | 6/1974 | O'Neill | 417/9 |
| 4,040,600 | 8/1977 | Coppola et al. | 251/63 |
| 4,172,582 | 10/1979 | Bobnar | 251/63 |
| 4,544,328 | 10/1985 | Credle, Jr. | 417/33 |

*Primary Examiner*—Leonard E. Smith

*Attorney, Agent, or Firm*—Michael, Best & Friedrich

[57] ABSTRACT

An air operated hydraulic fluid pump having an air pressure operated motor drivingly connected to a hydraulic fluid pump to drive the hydraulic fluid pump, and an airflow control valve controlling the supply of air from an air pressure source to the air pressure operated motor, the airflow control valve causing an increase in the supply of air to the air valve pressure operated motor in proportion to increase in the hydraulic fluid pressure generated by the hydraulic fluid pump.

13 Claims, 1 Drawing Sheet

AIR SPEED CONTROL VALVE AIR PRESSURE DRIVE HYDRAULIC FLUID PUMP

FIELD OF THE INVENTION

The invention relates to pneumatically operated or air driven hydraulic fluid pumps and more particularly to an air flow control apparatus for controlling flow of air pressure to a hydraulic fluid pump.

BACKGROUND PRIOR ART

In prior art air pressured powered hydraulic fluid pumps, the pumps may include a ball type valve as a throttling device for the pumps and for permitting the operator to control the quantity of air supplied to the hydraulic pump. One of the disadvantages of these arrangements is that the operator does not know how fast the air pump is turning and cannot properly adjust the valve. Even if a tachometer were employed to set the valve for low pressure operation of the pump, this control arrangement would require resetting in order to obtain optimum performance at higher hydraulic fluid pressures. The required constant adjustment of this arrangement makes it impractical.

In other prior art arrangements, an air regulator is used to limit the maximum air pressure supplied to the air pressure pump. This arrangement has deficiencies similar to those of the ball valve arrangement in that at higher hydraulic pressures, much of the pump performance will be lost.

Attention is also directed to the Houle U.S. Pat. No. 2,861,519, issued Nov. 25, 1958; the Credle U.S. Pat. No. 4,544,328, issued Oct. 1, 1985; the O'Neill U.S. Pat. No. 3,816,025, issued June 11, 1974; and the Henkel U.S. Pat. No. 2,630,758, issued Mar. 10, 1953.

Attention is also directed to the Moore U.S. Pat. No. 3,590,839 issued July 6, 1971; the Curnow U.S. Pat. No. 3, 787,027, issued Jan. 22, 1974; the Ashbrook U.S. Pat. No. 2,928,646, issued Mar. 15, 1960; the Cassarino U.S. Pat. No. 2,976,880, issued Mar. 28, 1961; the Hoffman U.S. Pat. No. 3,359,868, issued Dec. 26, 1967; the Pelton U.S. Pat. No. 2,509,880, issued May 30, 1950; the Bobnar U.S. Pat. No. 4,172,582, issued Oct. 30, 1979; and the Coppola U.S. Pat. No. 4,040,600, issued Aug. 9, 1977.

SUMMARY OF THE INVENTION

The present invention includes an air pressure driven hydraulic fluid pump including an air flow control valve for controlling air pressure and air flow volume supplied to the air operated pump, the quantity of air and the air pressure supplied to the air operated pump being dependent on the hydraulic fluid output pressure of the hydraulic pump. The air flow control valve includes means for causing the air flow control valve to open in response to an increase in the hydraulic fluid output pressure of the pump.

More particularly, the air flow control valve embodied in the air driven hydraulic fluid pump includes a valve body housing a valve spool. Means are provided for biasing the valve spool toward a closed position, or air flow limiting position. The valve arrangement also includes means for moving the valve spool toward an open position as the hydraulic fluid pressure generated by the pump increases and thereby increasing the supply of air to the hydraulic fluid pump as the hydraulic fluid pressure in the output port of the pump increases.

One of the principal features of the invention is that the provision of the air flow control valve provides means for preventing excessively high speed operation of the pump when the pump is operating at a low hydraulic fluid pressure, but wherein maximum air flow and air pressure are provided to the pump when the load on the air operated pump is maximum.

Another feature of the invention is that it provides for a gradual and controlled increase in the supply of air pressure to the hydraulic fluid pump during startup of the pump, thereby providing for efficient operation of the pump throughout the range of operation of the pump. In other words, air pressure delivered to the pump is not wasted when the pump is operated at only low operating speeds.

Various other features and advantages of the invention will be apparent by reference to the following description of a preferred embodiment, from the claims and from the drawings.

Figure 1:
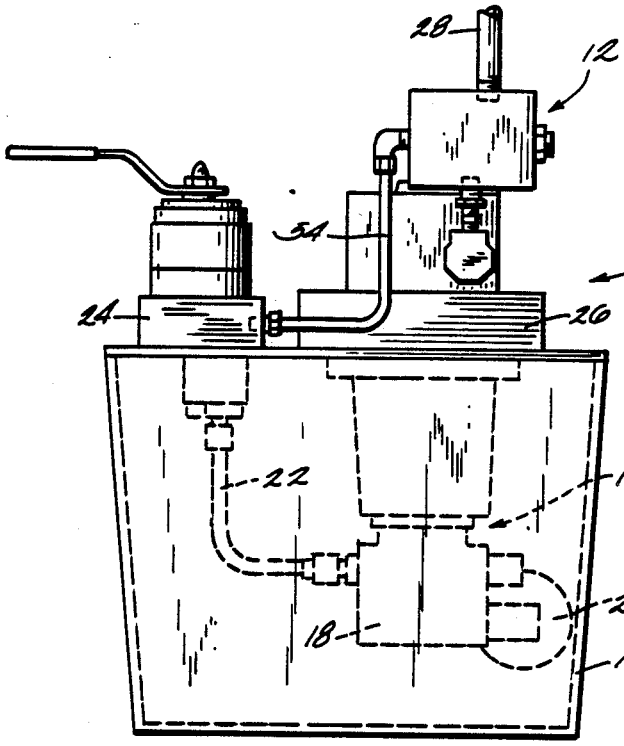
FIG. 1 is a side elevation view of an air pressure operated hydraulic fluid pump embodying the invention.

Before describing a preferred embodiment of the invention in detail, it is to be understood the invention is not limited in it application to the details of construction and to the arrangement set forth in the following description, nor illustrated in the drawings. The invention is capable of further embodiments and of being carried out in various ways. Also, it is to be understood that the phraseology and terminology employed is for the purpose of description and should not be regarded as limiting.

DESCRIPTION OF A PREFERRED EMBODIMENT

Illustrated in FIG. 1 is an air pressure driven hydraulic fluid Pump 10 embodying the invention and including an air flow control assembly 12 for controlling the supply of air to the air pressure driven pump 10. While the air pressure driven hydraulic fluid pump 10 could be constructed in other ways, in the illustrated arrangement it includes a hydraulic fluid pump 14 housed in a container or chamber 16 comprising a reservoir adapted to contain hydraulic fluid. The hydraulic fluid pump 14 has a conventional construction and generally includes a housing 18 and rotatably driven gears (not shown) functional to draw hydraulic fluid from the reservoir through a filter 20 and then discharge the hydraulic fluid through a discharge line 22. A manually operable hydraulic fluid control valve 24 is coupled to the hydraulic fluid discharge line 22. In practice the hydraulic fluid pump 14 can be used to supply hydraulic fluid under pressure to a number of applications which can include, for example, hydraulic fluid cylinders.

The hydraulic fluid pump 14 is driven by an air pressure operated motor 26. The air pressure operated motor 26 can have a conventional construction and can be drivingly connected to the hydraulic fluid pump 14 by conventional drive means. Air under pressure is supplied to the air pressure operated motor 26 through an air pressure line 28.

While various sources of air pressure could be used to drive or power the air pressure motor 26, in common applications, the air pressure line 28 will be of the type used in industrial applications for operation of air pressure driven tools.

Means are also provided for controlling the quantity and pressure of the air supplied to the air pressure operated motor 26 from the air line 28. This means includes an air flow control assembly 12 operably connected between the air line 28 and the air motor 26. The air flow control assembly 12 is shown in greater detail in FIGS. 2 and 3 and includes a valve body 30 having a central valve bore 32 including a valve seat 34. The valve body 30 also includes a valve inlet port 36 providing communication between the air line 28 and the valve bore 32 on one side of the valve seat 34. An air discharge port 38 communicates with the valve bore 32 on the other side of the valve seat 34. In the illustrated arrangement, the inlet Port 36 includes a threaded portion adapted to house a threaded coupling 40 of the air line 28. Similarly, the discharge port 38 includes a threaded portion adapted to house a threaded end of a coupling 42 intended to connect the discharge port 38 to the air pressure operated fluid pump motor.

The air flow control valve 12 further includes a valve member 44 housed in the valve bore 32, the valve member 44 including a valve face 46 adapted to selectively engage the valve seat 34, and the valve member 44 being reciprocably movable in the valve bore 32 to control the air flow past the valve seat 34. While the valve member could have other constructions, in the illustrated arrangement the valve face 46 of the valve member 44 comprises a frusto-conical surface, having a shallow angle with respect to a central longitudinal axis of the valve member. Because the valve member 44 has a shallow angle, the valve surface and valve seat function as a needle valve as the valve member moves toward and away from the valve seat so as to provide accurate control over the quantity of air flowing through the valve in response to movement of the valve member 44 with respect to the valve seat 34.

Means are also provided for actuation of the valve member 44 to cause movement of the valve member 44 away from the valve seat 34 to increase air flow through the valve in response to an increase in the hydraulic fluid pressure in the hydraulic fluid pressure supply line 22. More particularly, the means for actuating the valve member 44 provides movement of the valve face 46 away from the valve seat 34 in proPortion to the hydraulic fluid pressure in the line 22, such that as the hydraulic fluid pressure in the line 22 increases, thereby causing a consequent increase in the load on the hydraulic fluid pump 14, the supply of air pressure to the air motor 26 is increased. This means for actuation of the valve member 44 includes a valve stem or piston portion 50 integral with the valve member 44 and housed in a portion 52 of the valve bore functioning as a cylinder. A hydraulic fluid pilot pressure line 54 has one end connected to the hydraulic fluid discharge line 22 and an opposite end connected to the valve bore 52 such that hydraulic fluid in the discharge line 22 will be supplied to the valve bore 52 and so as to apply hydraulic fluid pressure on the piston end 50 of the valve member 44. At least one O-ring 56 surrounds the valve stem 50 and functions to provide a fluid tight seal between the valve stem 50 and the cylinder wall 52. In the illustrated arrangement a threaded coupling 58 at the end of the pilot pressure line 54 is threaded into a threaded bore 60 in the valve body.

Figure 2:
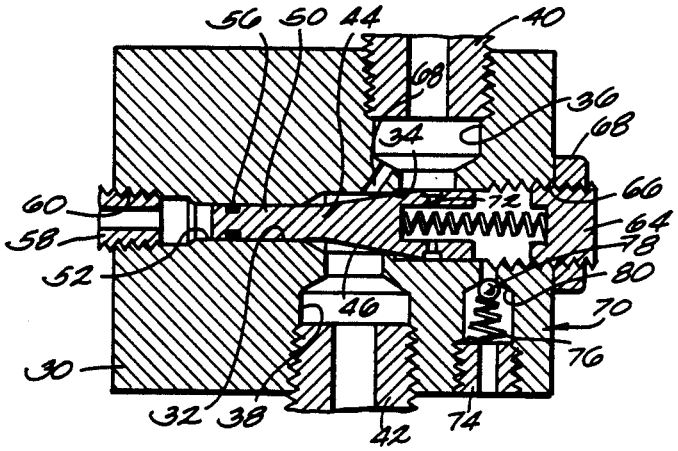
FIG. 2 is an enlarged cross section view of an air flow control assembly included in the air pressure operated hydraulic fluid pump shown in FIG. 1.
Figure 3:
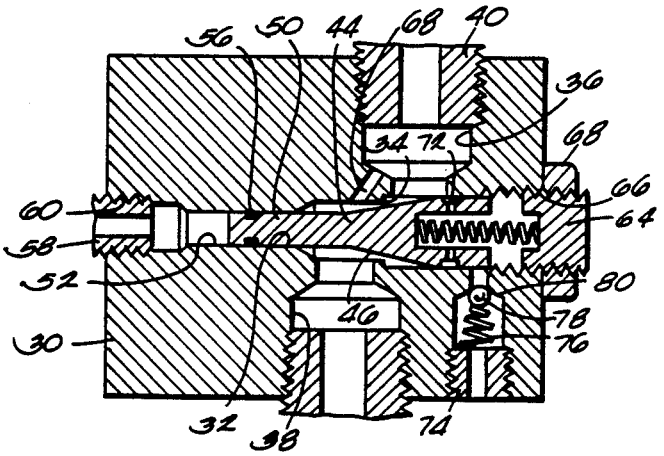
FIG. 3 is a view similar to FIG. 2 and showing the air flow control valve in an open position.

Means are also provided for biasing the valve member 44 to the left, as see in FIG. 2, to a position wherein the valve member 44 engages the valve seat 34. In the illustrated construction, this means for biasing includes a resilient compression spring 62 engaging the end of the valve member 44.

In one preferred form of the invention, means are also provided for adjusting the force of the compression spring 62 on the valve member 44. In the illustrated arrangement a screw 64 is threaded into a threaded end 66 of the valve bore 32 and engages an end of the spring 62. The screw 64 can be adjusted to control the compressive force of the compression spring 62 on the valve member 44. A locking nut 68 surrounds the adjustment screw 64 and also functions as a means for further insuring a fluid tight seal between the adjustment screw 64 and the valve body 30.

In a preferred form of the invention, the force on the valve member by the compression spring 62 will increase with the amount of compression on the compression spring.

Means are also provided for permitting a small controlled air flow from the inlet port 36 to the outlet port 38 of the the control valve 12 and past the valve seat 34 so as to provide for initial flow of air to the air pump 26 when the force of the hydraulic fluid pressure on the valve stem 50 is less than the force of the compression spring 62 on the valve member. In the illustrated arrangement this means is provided by a bleed port 69. The bleed port 69 must be of sufficient size that in operation of the pump, when the air pressure is initially supplied to the control valve 12 through the air line 28, the bleed port 69 will allow sufficient air flow to the air pump 26 that the hydraulic fluid pressure generated by the hydraulic fluid pump will be sufficient to begin to cause movement of the valve surface 46 away from the valve seat 34 whereby air flow through the valve will provide for increased hydraulic fluid output by the hydraulic fluid pump 14.

Means are further provided for venting air to the atmosphere when the air pressure supplied to the inlet port 36 exceeds a predetermined air pressure. While various means could be provided for venting air pressure, in the illustrated arrangement a spring biased ball valve 70 communicates with the air inlet port 36 through ports 72 in the valve member 44 and the valve bore. An adjustment screw 74 is provided for permitting adjustment of the compression of a spring 76 engaging a ball 78 and biasing the ball against a valve seat 80.

In operation of the air flow control valve 12 described above, during initial supply of air through the air line 28 to the air pump 26, the valve 12 is closed and the control valve provides air to the air pump only through the bleed port 68. As the air pump begins to drive the hydraulic fluid pump 14, hydraulic fluid pressure will be delivered to the cylinder 52 and will begin to bias the valve member 44 away from the valve seat 34. As the hydraulic fluid pump supplies hydraulic fluid to a hydraulic cylinder or the like, and the load on the pump increases, the pressure in the cylinder 52 will increase to thereby cause the valve member 44 to move toward a fully open position and thereby increase the supply of working air to the air pump for driving the hydraulic pump. If, on the other hand, there is no load on the hydraulic fluid pump, the hydraulic fluid pressure in the cylinder 52 will not increase and the valve member 44 will remain in an air flow limiting position.

Various features of the invention are set forth in the following claims.

1. An air driven hydraulic fluid pump comprising;

a hydraulic fluid reservoir;

a hydraulic fluid pump operably connected to the hydraulic fluid reservoir to pump hydraulic fluid from the hydraulic fluid reservoir and adapted to deliver the hydraulic fluid under pressure through a discharge port to a hydraulic fluid cylinder, the hydraulic fluid pump including a movable driven member;

an air pressure operated motor operably connected to the movable driven member to drive the movable driven member, and the air pressure operated motor being adapted to be connected to a source of air pressure; and an airflow control valve between the source of air pressure and the air pressure operated motor for controlling the amount of air pressure supplied to the air pressure operated motor, the airflow control valve including a valve body having an air pressure inlet port, an air pressure outlet port, a valve bore between the air pressure inlet port and the air pressure outlet port, a valve member housed in the valve bore and movable between an airflow restricting position and an open position, means for causing movement of the valve member toward the open position in response to an increase in the hydraulic fluid pressure generated by the hydraulic fluid pump at the discharge port, and means for resiliently biasing the movable valve member toward the flow restricting position.

2. An air driven hydraulic fluid pump as set forth in claim 1 wherein the airflow control valve increases the supply of air to the air pressure operated motor in proportion to the hydraulic fluid pressure generated by the hydraulic fluid pump.

3. An air driven hydraulic fluid pump as set forth in claim 1 wherein the air pressure control valve further includes an air pressure bleed port for providing flow of a controlled quantity of air from the air pressure inlet port to the air pressure outlet port when the valve member is in the airflow restricting position.

4. An air driven hydraulic fluid pump as set forth in claim 1 wherein an end of the movable valve member forms a piston and wherein a portion of the valve bore forms a cylinder housing the piston, and further including means for providing fluid communication between the discharge port of the hydraulic fluid pump and the cylinder housing the piston.

5. An air driven hydraulic fluid pump as set forth in claim 1 wherein the valve bore includes a valve seat and wherein the valve member includes a tapered frustoconical valve surface engageable with the valve seat.

6. An air driven hydraulic fluid pump as set forth in claim 1 wherein the airflow control valve further includes means for limiting the air pressure supplied to the air pressure operated fluid pump.

7. An air driven hydraulic fluid pump as set forth in claim 8 wherein the means for limiting includes an air pressure relief valve operably connected to the valve bore between the air pressure inlet port and the valve member and for discharging air pressure when the air pressure supplied to the valve bore through the inlet port exceeds a predetermined maximum pressure.

8. An airflow control valve for use in an air operated hydraulic fluid pump having an air pressure operated motor drivingly connected to a hydraulic fluid pump to drive the hydraulic fluid pump, and the hydraulic fluid pump having a discharge port, the airflow control valve controlling the supply of air from an air pressure source to the air pressure operated motor and comprising:

a valve body having an air pressure inlet port, an air pressure outlet port, a valve bore between the air pressure inlet port and the air pressure outlet port, a valve member housed in the valve bore and movable between an airflow restricting position and an open position, means for causing movement of the valve member toward the open position in response to an increase in the hydraulic fluid pressure generated by the hydraulic fluid pump at the discharge port to thereby increase the supply of air to the air pressure operated motor in proportion to increase in the hydraulic fluid pressure generated by the hydraulic fluid pump, and means for resiliently biasing the movable valve member toward the flow restricting position.

9. An airflow control valve as set forth in claim 8 and further including an air pressure bleed port for providing flow of a controlled quantity of air from the air pressure inlet port to the air pressure outlet port when the valve member is in the airflow restricting position.

10. An airflow control valve as set forth in claim 8 wherein an end of the movable valve member forms a piston and wherein a portion of the valve bore forms a cylinder housing the piston, and further including means for providing fluid communication between the discharge port of the hydraulic fluid pump and the cylinder housing the piston.

11. An airflow control valve as set forth in claim 8 wherein the valve bore includes a valve seat and wherein the valve member includes a tapered frustoconical valve surface engageable with the valve seat.

12. An airflow control valve as set forth in claim 8 wherein the airflow control valve further includes means for limiting the air pressure supplied to the air pressure operated fluid pump.

13. An airflow control valve as set forth in claim 12 wherein the means for limiting includes an air pressure relief valve operably connected to the valve bore between the air pressure inlet port and the valve member and for discharging air pressure when the air pressure supplied to the valve bore through the inlet port exceeds a predetermined maximum valve.

* * * * *

UNITED STATES PATENT AND TRADEMARK OFFICE

CERTIFICATE OF CORRECTION

PATENT NO. : 4,889,472

DATED : December 26, 1989

INVENTOR(S) : Decker et al.

It is certified that error appears in the above-identified patent and that said Letters Patent is hereby corrected as shown below:

In the drawings, Fig. 2, the reference numeral 62 should be applied to the compression spring acting on the valve member 44. In the drawings, Fig. 2, the reference numeral 69, rather than the reference numeral 68, should be applied to the air flow bleed port from the inlet port 36 to the outlet port 38 past the valve seat 34. In the drawings, Fig. 3, the reference numeral 62 should be applied to the compression spring acting on the valve member 44. In the drawings, Fig. 3, the reference numeral 69, rather than the reference numeral 68, should be applied to the air flow bleed port from the inlet port 36 to the outlet port 38 past the valve seat 34.

Column 6, line 4, for Claim 7, the reference numeral "8" should read ---6---.

Signed and Sealed this

Second Day of March, 1993

*Attest:*

STEPHEN G. KUNIN

*Attesting Officer*

*Acting Commissioner of Patents and Trademarks*